United States Patent [19]

Naismith et al.

[11] Patent Number: 4,648,947

[45] Date of Patent: Mar. 10, 1987

[54] CHROMIUM ELECTROPLATING AND BATH THEREFOR

[75] Inventors: John A. Naismith, Strathaven, Scotland; Malcolm McCormick; David Howe, both of Ecclesall, England; Malcolm A. Pate, Waterthorpe, England

[73] Assignee: National Research Development Corp., London, England

[21] Appl. No.: 729,216

[22] Filed: May 1, 1985

[30] Foreign Application Priority Data

May 1, 1984 [GB] United Kingdom ..... 8411063

[51] Int. Cl.[4] ..... C25D 3/04

[52] U.S. Cl. ..... 204/51

[58] Field of Search ..... 204/51; 148/6.21

[56] References Cited

U.S. PATENT DOCUMENTS

| | | | |
|---|---|---|---|
| 3,654,101 | 4/1972 | Aoun | 204/51 |
| 4,234,396 | 11/1980 | Perakh et al. | 204/51 |
| 4,450,050 | 5/1984 | Chessin | 204/41 |

FOREIGN PATENT DOCUMENTS

| | | | |
|---|---|---|---|
| 0073568 | 3/1983 | European Pat. Off. | 204/51 |
| 1383524 | 2/1975 | United Kingdom | 204/51 |
| 1419613 | 12/1975 | United Kingdom | 204/51 |
| 1464531 | 2/1977 | United Kingdom | 204/51 |

OTHER PUBLICATIONS

R. M. Krishnan et al., Metal Finishing, pp. 55–61, Oct. 1981.

*Primary Examiner*—G. L. Kaplan

*Attorney, Agent, or Firm*—Murray and Whisenhunt

[57] ABSTRACT

To a conventional chromium electroplating bath containing 450 g/l chromic acid $CrO_3$ and 4.5 g/l sulphuric acid $H_2SO_4$ are added 10 g/l of potassium perchlorate or potassium bromate or potassium iodate or mixtures thereof. Higher current densities may be used in electrodepositing chromium without impairing the quality.

8 Claims, No Drawings

CHROMIUM ELECTROPLATING AND BATH THEREFOR

This invention relates to a bath composition for chromium electroplating and to a method of electrodepositing chromium using such a bath composition.

For electroplating chromium onto a substrate (as opposed to electrowinning chromium), aqueous solutions of chromic acid $CrO_3$ are usually used, together with a catalyst anion, usually 1% sulphate, although fluoride and fluorosilicate are also used as catalysts. Perhaps the most useful addition is that of the complex fluoride ion, since the current efficiency of the chromium plating process is improved, and therefore the deposition rate is raised. Furthermore, the deposit produced has a higher hardness, and a higher crack density. Operational disadvantages of fluoride-containing baths are that they are particularly sensitive to changes in bath composition and electrolyte contamination (chiefly iron). The aggressive nature of the electrolyte can cause severe corrosion both to the anode and cathode areas where the current density is very low, and to the materials used in the vat construction. Moreover, since the analytical control of the fluoride content is relatively complicated, these solutions tend to be limited in their application, despite their advantages. Nonetheless these additions may be used in conjunction with the present invention.

Current densities at the cathode are usually limited to about 30 $A/dm^2$ (=3 $kA/m^2$) to avoid 'treeing' at the cathode edges, that is, uncontrolled spiky growths at points of high field gradient.

According to the present invention, a bath composition for chromium electroplating comprises $CrO_3$ in a concentration of from 200 g/l to 600 g/l such as 450 g/l, sulphate in a weight ratio $SO_4$:$CrO_3$ of from 1:120 to 1:80, perchlorate in a weight ratio $ClO_4$:$CrO_3$ of from 1:500 to 1:50, preferably 1:200 to 1:80, and metal cations (e.g. alkali metal cations) equivalent to at least substantially half, preferably all, the perchlorate. The bath composition may further comprise bromate or iodate or a mixture thereof in a weight ratio ($BrO_3$/$IO_3$):$CrO_3$ of from 1:20 to 1:50.

Also according to the present invention, a bath composition for chromium electroplating comprises $CrO_3$ in a concentration of from 200 g/l to 600 g/l such as 450 g/l, sulphate in a weight ratio $SO_4$:$CrO_3$ of from 1:120 to 1:80, bromate or iodate in a weight ratio ($BrO_3$ or $IO_3$):$CrO_3$ of from 1:20 to 1:600, preferably from 1:25 to 1:150, and metal cations (e.g. alkali metal cations) equivalent to at least half, preferably substantially all, the bromate or iodate. Bromate and iodate may be mixed within these limits.

Preferably the bath is compounded and then electrolysed before use.

The invention also provides a method of electrodepositing chromium onto a conductive substrate, comprising applying a cathodic potential to the substrate in a bath composition as set forth above, preferably at a current density on the cathode of from 4 to 12 $kA/m^2$ for perchlorate by itself, from $1\frac{1}{2}$ to 4 $kA/m^2$ for iodate by itself, from 10 to 50 $kA/m^2$ for bromate by itself, and from 15 to 50 $kA/m^2$ for bromate/perchlorate mixtures, preferably at a temperature of from 45° C. to 65° C.

Perchlorate and iodate are regarded as non-consumable additives while bromate due to its volatility should be replenished during operation especially if the temperature is allowed to rise.

The invention will now be described by way of example.

A solution was made up containing 450 g/l chromic acid $CrO_3$ and 4.5 g/l $H_2SO_4$ sulphuric acid. This is known throughout the specification as SA, and is not according to the invention.

To three samples of a chromic acid/sulphuric acid mixture, solutions of potassium perchlorate $KClO_4$ in warm de-ionised water were added to make solutions identical to SA but additionally containing 2 g/l, 5 g/l and 10 g/l potassium perchlorate; these solutions were stirred and electrolysed for 1 Ah/l before use for plating out impurities such as nitrate, as is common practice. These solutions are known respectively as SAC2, SAC5, and SAC10, and are according to the invention.

To two samples of SAC5, potassium bromate $KBrO_3$ was added in amounts of 5 g/l and 20 g/l, the resulting solutions being known as SAC5B5 and SAC5B20 respectively, and being according to the invention. These, too, were made by dissolving the potassium bromate in warm de-ionised water and adding this to the components for making SAC5, making up to the required concentrations as necessary, then stirring and electrolysing before use.

By corresponding techniques, solutions SAB5, SAB20, SAI5 and SAI20 were made up, containing 450 g/l $CrO_3$, 4.5 g/l $H_2SO_4$ and, respectively, 5 g/l $KBrO_3$, 20 g/l $KBrO_3$, 5 g/l potassium iodate $KIO_3$ and 20 g/l $KIO_3$.

All these solutions, when used as chromium electrodepositing baths, were held at 55° C. The cathode in these experiments was always 18/8 stainless steel and the anode (of twice the cathode area) was of lead. All these solutions would plate successfully also onto other cathodes such as of copper, chromium and vitreous carbon.

EXAMPLE SA

The behaviour of SA is now described as a basis of comparison.

At a current density of 2 $kA/m^2$, a chromium deposit whether grown to 5 microns thickness or to 25 microns thickness was dull-greyish matt with a smooth texture masking any minor surface irregularities on the cathode. Such a deposit is normally regarded as characteristic of too low a current density or too high a bath temperature. Hardness, at 700 to 850 HV, was nonetheless reasonable (800 to 900 being considered adequate for most engineering purposes).

At 5 $kA/m^2$, a chromium deposit grown to 6 or to 25 microns is nodular, bright, mirror-like and smooth to the touch. Pimples may be seen by the naked eye, and are outgrowths from nodules, perhaps 50 microns, with flaky structures. Hardness was 900 to 1050 HV. At $7\frac{1}{2}$ $kA/m^2$, the whole surface is covered with these outgrowths and hence (when grown to 6 microns) appears bright-matt and smooth, and when grown to 25 microns appears visually frosty with a rough surface texture.

At 10 $kA/m^2$, this frosty appearance arises even for 6-micron deposits, and at 20 $kA/m^2$ the appearance is milky-white with a rough surface texture.

The current efficiencies in this range of current densities were as follows for chromium plating to 6 microns and to 25 microns. (The results at 6 microns are less affected by the nodular outgrowths than are the 25-micron results.)

| | | | | | |
|---|---|---|---|---|---|
| Current density (kA/m$^2$) | 2 | 4 | 5 | 7½ | 10 |
| Current efficiency 6(η, %) | 8 | 11 | 11 | 13 | 15 |
| 25 | 10 | 10 | 10 | 19 | 22 |

EXAMPLE SAC2

The behaviour of bath composition SAC2 (i.e. including 2 g/l of potassium perchlorate) under the same conditions was as follows:

At 2 kA/m$^2$, the results were the same as in Example SA.

At 5 kA/m$^2$, and also at 6 kA/m$^2$, a chromium deposit whether grown to 6 or 25 microns is smooth, bright and shiny, and at 25 microns is nodular with occasional cracks. (Cracks of appropriate size and distribution in chromium plating can be positively beneficial.) There are no large outgrowths from the nodules. Hardness was about 900 HV.

At 7½ kA/m$^2$, the results are similar to Example SA 5 kA/m$^2$ but rough to the touch.

At 10 kA/m$^2$, the results are similar to Example SA 7½ kA/m$^2$.

Current efficiencies for 6-micron plating were:

| | | | | |
|---|---|---|---|---|
| Current density (kA/m$^2$) | 2 | 4 | 7½ | 10 |
| Current efficiency (η, %) | 7 | 10 | 12 | 17 |

Current efficiencies for 25-micron plating were similar except for being 2% better at the top two current densities.

EXAMPLE SAC5

The behaviour of bath composition SAC5 under the same conditions are as follows:

At 2 kA/m$^2$, the results were the same as in Example SA.

At 5 kA/m$^2$, at 7½ kA/m$^2$ and also at 10 kA/m$^2$, a chromium deposit grown to 6 microns is bright, shiny, smooth and crack-free, and grown to 25 microns is bright and mirror-like, and is smooth. At 10 kA/m$^2$, there are some few cracks. Hardness at 5 kA/m$^2$ was about 970 HV and at 10 kA/m$^2$ was 1050 to 1100 HV.

At 12½ kA/m$^2$, 15 kA/m$^2$ and 20 kA/m$^2$ respectively, the surfaces are pimpled, somewhat flaky and totally flaky; they are all dull-matt and rough.

Current efficiencies for 6-micron plating were:

| | | | | | | | |
|---|---|---|---|---|---|---|---|
| Current density (kA/m$^2$) | 2 | 5 | 7½ | 10 | 12½ | 15 | 20 |
| Current efficiency (η, %) | 6 | 10 | 12 | 13 | 14 | 15 | 16 |

Current efficiencies for 25 micron plating were identical except at 15 kA/m$^2$ (23%) and 20 kA/m$^2$ (25%).

EXAMPLE SAC10

The behaviour of bath composition SAC10 under the same conditions was as follows:

At 2 kA/m$^2$, the results were the same as in Example SA.

At 5 kA/m$^2$ and also at 10 kA/m$^2$, a chromium deposit grown to 6 or to 25 microns is visually bright and mirror-like and is smooth to the touch. Hardness at 5 kA/m$^2$ was about 960 HV and at 10 kA/m$^2$ was 1100 to 1200 HV.

At 12½ kA/m$^2$, the results are unacceptable and somewhat similar to those of SA at 2 kA/m$^2$. At all current densities higher than 12½ kA/m$^2$, the chromium deposits are at best dull-matt and have rough surface textures.

Current efficiencies for 6-micron plating were:

| | | | | | | | | |
|---|---|---|---|---|---|---|---|---|
| Current density (kA/m$^2$) | 2 | 5 | 7½ | 10 | 12½ | 15 | 17½ | 20 |
| Current efficiency (η, %) | 7 | 10 | 12 | 13 | 13 | 12 | 12 | 12 |

Current efficiencies for 25-micron plating were identical within the usual range of current densities.

In Examples SA, SAC2, SAC5 and SAC10, current efficiencies of 20% are obtainable during 25-micron plating but are always associated with deposits having a totally flake-type structure. Such deposits are obtained as follows:

| Bath composition | SA | SAC2 | SAC5 | SAC10 |
|---|---|---|---|---|
| Current density (kA/m$^2$) above which flake-type structure is obtained | 5 | 7½ | 17½ | 20 |
| Current density (kA/m$^2$) up to which smooth bright 25 micron desposit is obtained | 5 | 6 | 10 | 10 |

EXAMPLES SAC5B5 AND SAC5B20

Use of the bath compositions SAC5B5 and SAC5B20 gave visually dull and dark grey deposits with rough surface textures, except for SAC5B20 at 20 kA/m$^2$, which appears silky-grey and is smooth to the touch.

Current efficiencies for 6-micron plating were:

| Current density (kA/m$^2$) | 2 | 5 | 10 | 15 | 20 |
|---|---|---|---|---|---|
| Current efficiency (η, %) | | | | | |
| SAC5B5 | 10 | 21 | 23 | 23 | 24 |
| SAC5B20 | 4 | 20 | 29 | 35 | 35 |

EXAMPLES SAB5, SAB10, SAI5 AND SAI10

The results from using these bath compositions are summarised as follows:

| | Current density (kA/m$^2$) | Current efficiency (η, %) | Comments |
|---|---|---|---|
| SAB5 | 5 | 19 | black-grey deposit, rough growth. |
| SAB20 | 15 | 33 | silky-grey, smooth, adherent coating, porous without microcracks, 1400 to 1500 HV. |
| SAB20 | 20 | 35 | |
| SAI5 | 2 | 28 | dense grey adherent deposit, 400 to 500 HV, a few microcracks. |
| SAI20 | 2 | 26 | |
| SAI5 | 5 | 24 | grey deposit, poorly adherent, 600 HV, a few microcracks. |
| SAI20 | 5 | 23 | |

With the SAI solutions, it will be seen that current efficiency actually falls as current density goes from 2 to 5 kA/m$^2$. This effect discourages treeing and stabilises smooth deposits.

We claim:

1. A bath composition for chromium electroplating comprising $CrO_3$ in a concentration of from 200 g/l to 600 g/l, sulphate in a weight ratio $SO_4$:$CrO_3$ of from 1:120 to 1:80, perchlorate in a weight ratio $ClO_4$:$CrO_3$ of from 1:500 to 1:50, bromate in a weight ratio $BrO_3$:-$CrO_3$ of from 1:50 to 1:20, and metal cations equivalent to at least half the perchlorate plus bromate.

2. A bath composition according to claim 1, wherein the perchlorate has a weight ratio $ClO_4$:$CrO_3$ of from 1:200 to 1:80.

3. A bath composition according to claim 1, wherein the metal cations are equivalent to substantially all the perchlorate plus bromate.

4. A bath composition according to claim 1, wherein some or all of the metal cations are alkali metal cations.

5. A bath composition according to claim 1, which has been electrolysed before use for chromium electroplating.

6. A method of electroplating chromium onto a substrate, comprising applying a cathodic potential to the substrate in a bath composition according to claim 1.

7. A method according to claim 6, wherein the current density on the substrate is from 15 to 50 $kA/m^2$.

8. A method according to claim 6, wherein the temperature is from 45° to 65° C.

* * * * *